US006585282B2

(12) United States Patent
Merino et al.

(10) Patent No.: US 6,585,282 B2
(45) Date of Patent: Jul. 1, 2003

(54) ELEMENT FOR RETAINING THE FRONT PORTION OF A BOOT ON A SKI

(75) Inventors: Jean-François Merino, Epagny (FR); Philippe Miette, Annecy le Vieux (FR); Daniel Soldan, Seynod (FR); Gilles Renaud-Goud, Gruffy (FR); Pascal Thomas, Chambery (FR)

(73) Assignee: Salomon S.A., Metz-Tessy (FR)

( * ) Notice: Subject to any disclaimer, the term of this patent is extended or adjusted under 35 U.S.C. 154(b) by 46 days.

(21) Appl. No.: 09/842,781

(22) Filed: Apr. 27, 2001

(65) Prior Publication Data

US 2001/0038193 A1 Nov. 8, 2001

(30) Foreign Application Priority Data

May 4, 2000 (FR) ..... 00 05832

(51) Int. Cl.[7] ..... A63C 9/10
(52) U.S. Cl. ..... 280/634; 280/625
(58) Field of Search ..... 280/607, 611, 280/623, 626, 628, 631, 633, 634, 625, 629; 74/497, 570

(56) References Cited

U.S. PATENT DOCUMENTS

| | | | | |
|---|---|---|---|---|
| 4,735,434 A | * | 4/1988 | Sedlmair | 280/634 |
| 4,834,414 A | | 5/1989 | Sedlmair | 280/625 |
| 4,869,525 A | * | 9/1989 | Gallet et al. | 280/626 |
| 4,940,253 A | * | 7/1990 | Brischoux | 280/634 |
| 5,048,853 A | * | 9/1991 | Trefz et al. | 280/91 |
| 5,199,736 A | | 4/1993 | Jungkind | 280/618 |
| 5,240,275 A | * | 8/1993 | Jungkind | 280/626 |
| 5,639,108 A | * | 6/1997 | Challande et al. | 280/633 |
| 5,785,343 A | * | 7/1998 | Challande et al. | 280/634 |
| 5,957,481 A | * | 9/1999 | Stepanek et al. | 280/634 |
| 5,997,026 A | * | 12/1999 | Klubitschko et al. | 280/607 |
| 6,286,856 B1 | * | 9/2001 | Rocca | 280/634 |

FOREIGN PATENT DOCUMENTS

| | | |
|---|---|---|
| DE | 19518760 | 11/1996 |
| DE | 19635681 | 3/1998 |
| EP | 0271694 | 6/1991 |
| EP | 0739646 | 10/1996 |
| EP | 0785002 | 7/1997 |
| EP | 0785003 | 7/1997 |
| EP | 0807453 | 11/1997 |
| EP | 0807454 | 11/1997 |
| EP | 0820331 | 9/1998 |
| FR | 1503847 | 12/1997 |
| FR | 1503848 | 12/1997 |
| FR | 1503849 | 12/1997 |

OTHER PUBLICATIONS

U.S. patent application No. 09/842,782 (Merino et al.), filed on Apr. 27, 2001.

* cited by examiner

*Primary Examiner*—Paul N. Dickson
*Assistant Examiner*—Christopher Bottorff
(74) *Attorney, Agent, or Firm*—Greenblum & Bernstein, P.L.C.

(57) ABSTRACT

The invention relates to an element for retaining a boot on a ski including a body and a retaining jaw that are generally symmetrical with respect to a longitudinal and vertical median plane, the jaw being biased by a return spring housed in the body, the return spring being connected to the jaw by an anchor having two lateral arms, a central strap and a central fork having two teeth, the spring elastically maintaining the arms of the anchor in support against two retaining pins affixed to the body, the jaw having a median pin engaged between the two teeth of the fork. At least one of the elements of the anchor, which are the arms, the strap and the fork, is asymmetrical with respect to the longitudinal and vertical median plane defined by the body and the jaw.

8 Claims, 2 Drawing Sheets

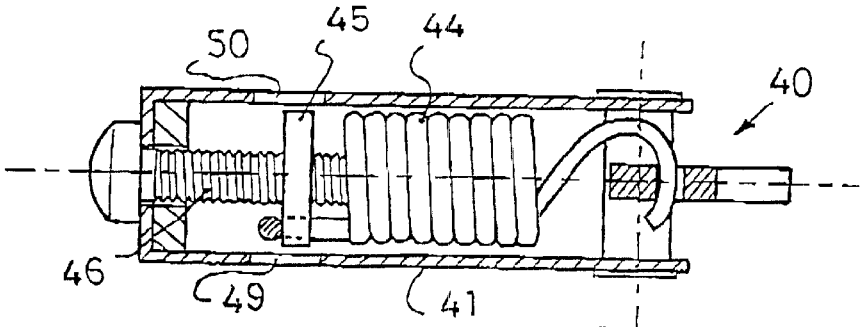
Fig. 6
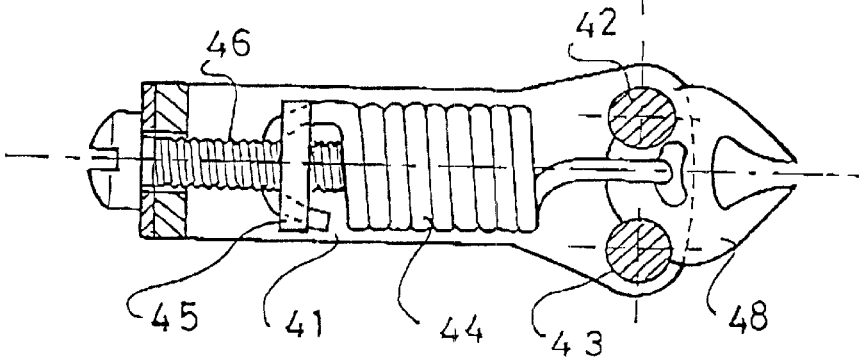
Fig. 7
Fig. 8
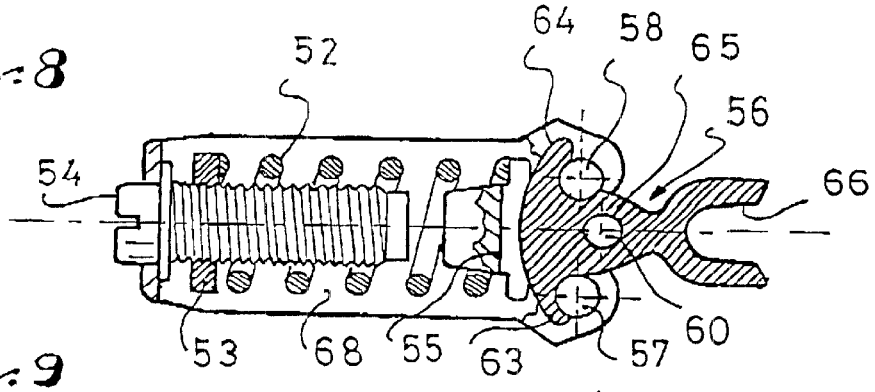
Fig. 9
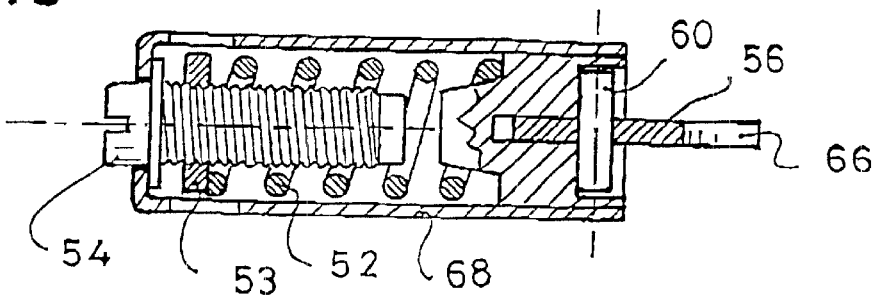

ELEMENT FOR RETAINING THE FRONT PORTION OF A BOOT ON A SKI

BACKGROUND OF THE INVENTION

1. Field of the Invention

The present invention relates to an element for retaining the front portion of a boot on a ski, i.e., a front ski binding.

More specifically, the invention relates to a retaining element with asymmetrical release, i.e., whose parameters for releasing the boot are different depending on the direction in which the boot biases the retaining jaw.

2. Description of Background and Relevant Information

In a known fashion, a front retaining element includes a retaining jaw that is maintained in a centered position on the ski by an elastic return device. In response to the forces exerted by the boot, the jaw is capable of moving laterally from either side of this aligned position until enabling the release of the boot.

It is also known that a skier's knee can withstand a higher torsional force of the leg if the foot is driven outward; conversely, the knee is more fragile if the foot is driven toward the other foot. These torsional forces translate into a lateral force exerted by the front portion of the boot on the jaw.

To take His into account, constructions of a front retaining element with asymmetrical release have been proposed. Such constructions have been disclosed in particular in the patent documents FR 1 503 847, FR 1 503 848, FR 1 503 849, EP 785 002, EP 785 003, and EP 807 454.

SUMMARY OF THE INVENTION

An object of the invention is to provide a new mode of construction of an element for retaining the front portion of a boot which has an asymmetrical lateral release mode of operation.

This new mode applies to a construction of an abutment which is said to have an anchor. In the language of the invention, such an anchor is a movable connecting element located between the jaw and its return spring which is maintained in support against two retaining abutments located on both sides of the line of action of the spring, and which the jaw drives in a movement relative to either one of these two abutments, depending on its moving direction.

A return mechanism with an anchor is described, for example, in the patent documents EP 271 694, DE 196 35 681, and U.S. Pat. No. 4,834,414, the disclosures of which are hereby incorporated by reference thereto in their entireties.

The retaining element according to the invention includes a body and a retaining jaw that are generally symmetrical with respect to a longitudinal and vertical median plane, the jaw being laterally movable on both sides of a central position toward which it is biased by a return spring housed in the body, the return spring being connected to the jaw by an anchor having two lateral arms and a central strap and a central fork having two teeth, the spring being connected to the central strap, and elastically maintaining the arms of the anchor in support against two retaining pins affixed to the body, the jaw having a median pin engaged between the two teeth of the fork which drives the fork during its lateral displacement.

At least one of the elements of the anchor, which are the arms, the strap and the fork, is asymmetrical with respect to the longitudinal and vertical median plane defined by the body and the jaw.

BRIEF DESCRIPTION OF DRAWINGS

The invention will be better understood from the description that follows, with reference to the annexed drawings, in which.

FIG, 6 shows a side cross-sectional view of an elastic return cartridge according to an alternative embodiment of the invention;

FIG. 7 shows a top partial cross-sectional view of the cartridge of FIG. 6;

FIGS. 8 and 9 show, in the same manner, a return cartridge according to another alternative embodiment.

DETAILED DESCRIPTION OF THE INVENTION

Figure 1:
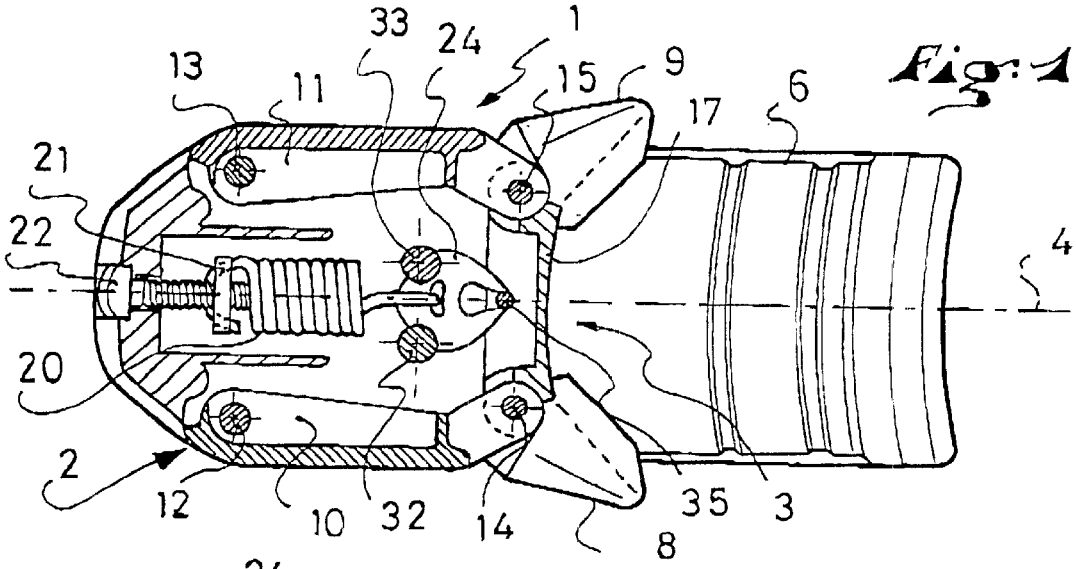
FIG. 1 shows a top partial cross-sectional view of a front retaining element according to a first embodiment of the invention.

FIG. 1 shows, by way of illustration of the invention, a retaining cartridge 1 which is essentially known from the aforementioned patent document EP 271 694.

This element includes a body 2 and a jaw 3 which are symmetrical with respect to the vertical median plane, designated by the reference line 4 in the plane of FIG. 1.

The retaining element is extended rearwardly by a support element 6 provided to receive the boot.

The jaw 3 generally includes two lateral wings 8 and 9. The wings are mounted at the end of arms 10 and 11 journalled on the front of the body about substantially vertical axes 12 and 13. The wings are themselves mounted so as to be journalled about axes 14 and 15 borne by the aims 10 and 11, and maintained at a distance by a crosspiece 17 which extends between the wings. The assembly formed by the body in its portion located between the axes 12 and 13, the two arms 10 and 11 and the crosspiece 17 forms a variable quadrangle which can deform following a displacement of the jaw on both sides of a centered position aligned with the previously defined vertical median plane.

Each wing is further locked with respect to the crosspiece by a cam mechanism which releases the wing beyond a predetermined deformation of the quadrangle. This mechanism is not shown in the drawing figures.

An elastic return device is provided to return the jaw to its centered position.

According to FIG. 1, this mechanism includes a tension spring 20. The front end of the spring is hooked to a nut 21 screwed on a screw 22 retained in the body 2. The other end of the spring is hooked to an anchor 24 which ensures the linkage with the jaw.

Figure 2:
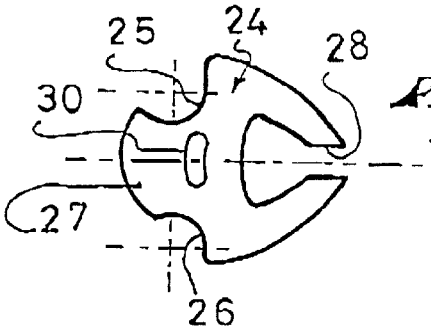
FIG. 2 is an enlarged view of the anchor of FIG. 1.

The anchor 24 is more particularly visible in FIG. 2. It includes two lateral arms 25 and 26, a central strap 27 oriented toward the spring, and a central fork 28 oriented on the other side toward the jaw.

As shown in FIG. 1, the spring 20 is hooked to a housing 30 of the anchor located in the central strap. Under the effect of the spring tension the two arms 25 and 26 are applied against two retaining pins 32, 33 affixedly connected to the body. Finally, a pin 35 affixed to the crosspiece 17 is engaged between the two teeth of the fork 28.

The anchor 24 is made out of any appropriate material, in particular, metal.

The functioning is as follows. When a wing of the jaw is subject to a lateral force, the crosspiece 17 is laterally offset, its displacement being controlled by the arms 10 and 11. The crosspiece drives the anchor along by forcing one of the arms to wind about its retaining pin. Conversely, the other arm leaves the support of its pin. When the force ceases, or when the boot is released, the spring brings the jaw back to its centered position.

The retaining element 1 has an asymmetrical functioning, i.e., the jaw must overcome a return force exerted by the spring which is more substantial on one side than on the other.

To obtain this effect, one of the elements of the anchor is rendered asymmetrical.

According to a first embodiment shown in FIGS. 1 and 2, the two arms 25 and 26 of the anchor are asymmetrical, and the two retaining pins are in non-symmetrical positions with respect to the vertical and longitudinal median plane, so that the anchor exerts its traction on the spring with different lever as depending on the pin around which it winds.

To this end, FIGS. 1 and 2 show arms 25 and 26 and pins 32 and 33 that are located at a different distance from the vertical and longitudinal median plane.

Figure 3:
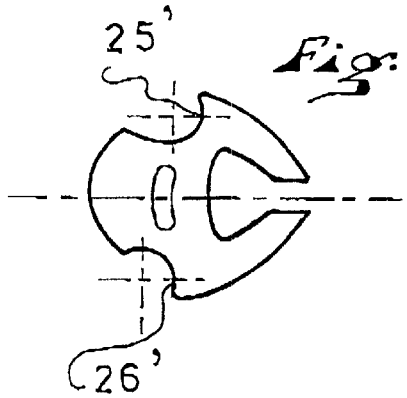
FIGS. 3, 4 and 5 show alternative embodiments of the anchor.

In the alternative embodiment shown in FIG. 3, the arms 25' and 26' of the anchor are offset along a longitudinal direction. The retaining pins are offset on the body in a corresponding fashion. By operating in this manner, one ply plays with the lever arm with which the crosspiece of the jaw drives the anchor.

One could also combine a lateral offset and an oblique offset.

In view of these differences of in the lever arms, the jaw drives the anchor more easily on one side than on the other.

Figure 4:
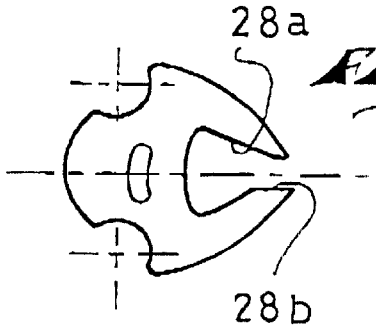

According to an alternative embodiment shown in FIG. 3, one of the teeth of the fork has a shape that is not symmetrical with respect to the other tooth. Thus, according to FIG. 4, the tooth 28*a* has a base that is farther from the longitudinal median plane than its end. In the centered position of the jaw, the pin 35 biases the end of the tooth. As the anchor winds around the pin, the pin biases the base of the tooth.

According to this variation, for a same range of displacement of the jaw on one side and the other of the median plane, one obtains different winding amplitudes of the anchor around either one of the pins, resulting in a variation in the return force exerted by the spring.

Figure 5:
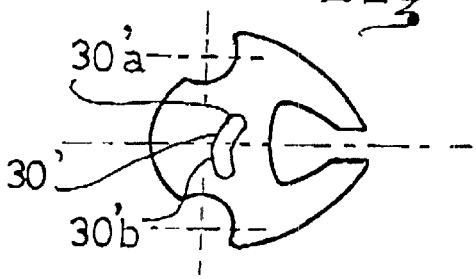

According to the variation shown in FIG. 5, one plays with the form of the cutout for hooking the spring. The cutout 30' is shown therein in the form of a slit which extends along a generally transverse direction with respect to the longitudinal median plane. The end of the spring moves in the slit as the anchor rotates. The two portions 30'*a* and 30'*b* of the slit are not symmetrical with respect to the median plane so that this spring stretches in a different manner depending on the moving direction of the jaw.

One could combine two or more of the various alternative embodiments that have been described.

FIGS. 6 and 7 show a return cartridge 40 which has an interesting application within the scope of the present invention.

This cartridge includes a cage 41 made, for example, of a beat sheet metal. The cage has two upper and lower surfaces. The pins 42 and 43 are assembled to these surfaces; for example, they are crimped by their ends. The spring 44, the hooking nut 45 and the screw 46 are mounted within the cage. The anchor 48 is drawn in support by the spring against the pins 42 and 43.

The cartridge thus obtained is asymmetrical, the anchor and the pins being obtained according to one of the previously described alternative embodiments.

This cartridge forms a self-contained sub-assembly, i.e., it is independent of the remainder of the retaining element. It is provided to be housed in the body and to receive the pin of the crosspiece between the teeth of the fork upon the complete assembly of the element.

The advantage of this device is that it is reversible. With a single cartridge of this type, obtained with the same pieces, one can obtain two different models of retaining elements provided to be associated with right and left boots, respectively. To reverse the asymmetry of the functioning of this cartridge, it suffices indeed to mount it in either direction so as to reverse the relative positions of the upper and lower surfaces of the cage.

Advantageously, a slit 49, 50 has been provided on each of the surfaces. The position of the hooking nut is rendered visible from the outside through the slit of the surface which is located toward the top, and from an appropriate window of the body. Thus, it is possible to verify the initial stretching state of the spring for its two mounting methods FIGS. 8 and 9 relate to another embodiment of the anchor.

The return spring is a compression spring which is in support at one end against a nut 53 screwed on a screw 54 whose head rests against the wall of a cage 56, or directly against the body. The other end of the spring presses on a piston 55 that pushes the anchor 56 back against two retaining pins 57 and 58.

The piston is connected to the anchor about a pivot 60 that extends through a bore of the anchor.

As in the preceding case, the anchor has two arms 63 and 64 that are in support against the pins 57 and 58, and which are capable of winding around one or the other. As the spring is a thrust spring, the arms of the anchor are oriented in the other direction. The strap is formed by the central portion 65 of the anchor located toward the front, which is crossed by the pivot 60. Toward the front, the anchor has a fork with two teeth, provided to receive a pin of the jaw or another equivalent element.

As in the preceding case, the functioning of the sub-assembly thus formed is rendered asymmetrical by constructing the anchor in an asymmetrical manner at the level of its arms or of the fork.

As in the preceding embodiment, the sub-assembly can be mounted in a cage 68 so as to form a self-contained and reversible cartridge.

The present description is provided for guidance only, and other embodiments of the invention could be adopted without leaving the scope thereof The instant application is based upon French Patent Application No. 00 05832, filed May 4, 2000, the disclosure of which is hereby incorporated by reference thereto in its entirety, and the priority of which is hereby claimed under 35 U.S.C. §119.

What is claimed is:

1. An element for retaining a boot on a ski, said retention element comprising:

a body and a retaining jaw that are generally symmetrical with respect to a longitudinal and vertical median plane, said jaw being laterally movable on both sides of a central position;

a return spring housed in said body, said jaw being biased by said return spring to said central position;

an anchor connecting said return spring to said jaw, said anchor comprising a plurality of elements, said plurality of elements including two lateral arms, a central strap and a central fork having two teeth, each of said arms of said anchor being offset with respect to the other along a longitudinal direction;

two retaining pins affixed to said body, said spring being connected to said central strap and elastically maintaining said arms of said anchor in support against said two retaining pins;

said jaw having a median pin engaged between said two teeth of said fork for driving said fork during lateral displacement of said fork, at least one of said plurality of elements of said anchor being asymmetrical with respect to said longitudinal and vertical median plane of said body and said jaw.

2. An element for retaining a boot on a ski, said retention element comprising:

a body and a retaining jaw that are generally symmetrical with respect to a longitudinal and vertical median plane, said jaw being laterally movable on both sides of a central position;

a return spring housed in said body, said jaw being biased by said return spring to said central position;

an anchor connecting said return spring to said jaw, said anchor comprising a plurality of elements, said plurality of elements including two lateral arms, a central strap and a central fork having two teeth, said two arms of said anchor being offset along a transverse direction;

two retaining pins affixed to said body, said spring being connected to said central strap and elastically maintaining said arms of said anchor in support against said two retaining pins;

said jaw having a median pin engaged between said two teeth of said fork for driving said fork during lateral displacement of said fork, at least one of said plurality of elements of said anchor being asymmetrical with respect to said longitudinal and vertical median plane of said body and said jaw.

3. An element for retaining a boot on a ski, said retention element comprising:

a body and a retaining jaw that are generally symmetrical with respect to a longitudinal and vertical median plane, said jaw being laterally movable on both sides of a central position;

a return spring housed in said body, said jaw being biased by said return spring to said central position;

an anchor connecting said return spring to said jaw, said anchor comprising a plurality of elements, said plurality of elements including two lateral arms, a central strap and a central fork having two teeth, said teeth of said anchor being asymmetrical with respect to the longitudinal and vertical median plane;

two retaining pins affixed to said body, said spring being connected to said central strap and elastically maintaining said arms of said anchor in support against said two retaining pins;

said jaw having a median pin engaged between said two teeth of said fork for driving said fork during lateral displacement of said fork, at least one of said plurality of elements of said anchor being asymmetrical with respect to said longitudinal and vertical median plane of said body and said jaw.

4. An element for retaining a boot on a ski, said retention element comprising:

a body and a retaining jaw that are generally symmetrical with respect to a longitudinal and vertical median plane, said jaw being laterally movable on both sides of a central position;

a return spring housed in said body, said jaw being biased by said return spring to said central position;

an anchor connecting said return spring to said jaw, said anchor comprising a plurality of elements, said plurality of elements including two lateral arms, a central strap and a central fork having two teeth, said strap having a cutout for hooking said spring, said cutout having respective portions extending transversely on opposite sides of said longitudinal and vertical median plane, said cutout being asymmetrical relative to said plane;

two retaining pins affixed to said body, said spring being connected to said central strap and elastically maintaining said arms of said anchor in support against said two retaining pins;

said jaw having a median pin engaged between said two teeth of said fork for driving said fork during lateral displacement of said fork, at least one of said plurality of elements of said anchor being asymmetrical with respect to said longitudinal and vertical median plane of said body and said jaw.

5. A boot-retention element according to claim 1, wherein said spring, said anchor, and said pins are mounted within a cage having an upper surface, a lower surface, so as to form a self-contained cartridge provided to be mounted in said body according to any of two different positions.

6. A boot-retention element according to claim 2, wherein said spring, said anchor, and said pins are mounted within a cage having an upper surface, a lower surface, so as to form a self-contained cartridge provided to be mounted in said body according to any of two different positions.

7. A boot-retention element according to claim 3, wherein said spring, said anchor, and said pins are mounted within a cage having an upper surface, a lower surface, so as to form a self-contained cartridge provided to be mounted in said body according to any of two different positions.

8. A boot-retention element according to claim 4, wherein said spring, said anchor, and said pins are mounted within a cage having an upper surface, a lower surface, so as to form a self-contained cartridge provided to be mounted in said body according to any of two different positions.

* * * * *